United States Patent [19]

Trumble et al.

[11] 4,441,213

[45] Apr. 10, 1984

[54] FLEXIBLE TEAR RESISTANT PROTECTIVE GLOVE FOR USE ON HIGH VOLTAGE SYSTEMS

[75] Inventors: William P. Trumble, Kanata; Ivan E. Martin; Clément E. Berthiaume, both of Ottawa, all of Canada

[73] Assignee: Northern Telecom Limited, Montreal, Canada

[21] Appl. No.: 385,431

[22] Filed: Jun. 7, 1982

[51] Int. Cl.[3] ..... A41D 19/00

[52] U.S. Cl. ..... 2/161 R; 2/163; 2/168; 2/169

[58] Field of Search ..... 2/166, 167, 168, 165, 2/164, 158, 161 R, 163

[56] References Cited

U.S. PATENT DOCUMENTS

| | | | |
|---|---|---|---|
| 3,662,054 | 5/1972 | Wollmann et al. | 2/167 |
| 3,867,727 | 2/1975 | Povlacs | 2/167 |

FOREIGN PATENT DOCUMENTS

| | | | |
|---|---|---|---|
| 957831 | 2/1957 | Fed. Rep. of Germany | 2/158 |
| 2603015 | 1/1976 | Fed. Rep. of Germany | 2/168 |
| 796667 | 1/1936 | France | 2/163 |
| 1508320 | 11/1967 | France | 2/168 |
| 809741 | 5/1959 | United Kingdom | 2/168 |
| 1105471 | 5/1968 | United Kingdom | 2/168 |

*Primary Examiner*—Werner H. Schroeder
*Assistant Examiner*—Tracy Graveline
*Attorney, Agent, or Firm*—Sidney T. Jelly

[57] ABSTRACT

A flexible, tear resistant, protective glove, particularly for use near live wires or equipment, is of unitary structure, having an inner layer of natural rubber, particularly suited for high voltage protection, and an outer layer of urethane elastomer bonded thereto and giving tear and abrasion resistance. Bulges are formed across the back of the main portion of the glove and across the back at each finger and the thumb, to provide excess material which permits ready bonding of fingers and thumb for gripping, without restriction by the glove.

6 Claims, 3 Drawing Figures

FLEXIBLE TEAR RESISTANT PROTECTIVE GLOVE FOR USE ON HIGH VOLTAGE SYSTEMS

For installers working on, or near, high voltage wires and equipment, it is necessary to wear protective gloves, to protect the person from results of an accidental contact with a live wire or equipment. A particular example is telephone linesmen who could be repairing, maintaining or installing telecommunication equipment adjacent to high voltage distribution wires and related equipment.

It is often necessary for such a person to handle very small objects, such as screws, bolts, nuts, and the like.

Conventional gloves comprise two layers, an inner layer of natural rubber, to give the high voltage protection, and an outer layer of leather, which gives resistance to tearing by protecting the rubber. However, the leather makes the glove very flexible as it prevents folding and buckling of the rubber which in turn is then resistant to flexing. As a result there is a tendency for users to remove their gloves when handling small items.

The present invention provides a glove which is flexible, has the desired protection against high voltages and is resistant to tears and abrasion. A glove comprises an inner layer of natural rubber, of a thickness to suit the voltage protection required, and an outer layer of urethane elastomer, the two layers bonded together. A plurality of pleats or localized bulges are formed at predetermined positions.

The invention will be understood by the following description in conjunction with the accompanying drawings, in which.

Figure 3:
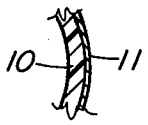
FIG. 3 is a cross-section on the line III—III of FIG. 2.

The glove as illustrated, is formed of two layers, an inner layer of natural rubber, formulated to give good high voltage resistance, and an outer layer of a urethane elastomer. These two layers are illustrated in FIG. 3 at 10 and 11 respectively. The thickness of the inner layer 10 is varied in accordance with the desired high voltage protection to be provided. Typically, the inner layer can vary from about 0.040 inches up to about 0.120 inches. Thicknesses of 0.040 to 0.060 are used for the 20–25 KV range with thicker layers provided for higher voltage protection. A typical thickness for the urethane layer 11 is about 0.003 to 0.010 inches.

The urethane layer provides extremely high resistance to cuts, tearing, puncturing and abrasion. It also bonds very well to the rubber layer.

As stated previously, with the conventional rubber/-leather glove, problems of flexibility arise. This is because the leather glove prevents any useful amount of folding and buckling of the rubber layer, which folding and buckling is essential when the user wishes to flex fingers and/or hand such as to form a fist. For example gripping a nut to screw it on to a bolt requires bending of the fingers and thumb primarily at the region of the joints between fingers and the main part of the hand. In many cases it is impossible to close fingers and thumb together, particularly with the higher voltage protection gloves, and yet this is the most dangerous situation.

Figure 1:
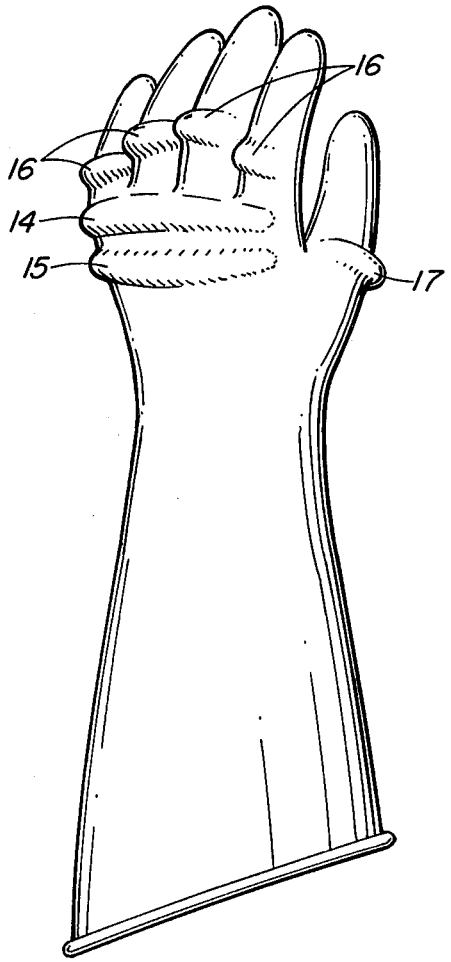
FIG. 1 is a perspective view on the back of one form of glove in accordance with the invention.
Figure 2:
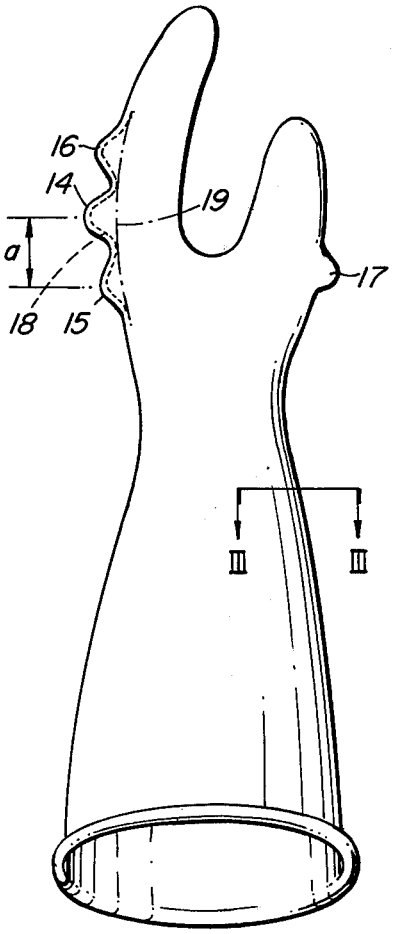
FIG. 2 is a side view of a glove, as in FIG. 1.

With the present invention, local bulges are formed at the back of the glove, extending across the glove, a bulge at the back of each finger, and also a bulge at a position corresponding to the base of the thumb, at the back of the thumb. These bulges, or pleats or other varied formations, are illustrated in FIGS. 1 and 2. Firstly there are two transverse bulges 14 and 15 across the back of the glove, the upper bulge 14 level with the knuckles farthest from the finger tips, with lower bulge 15 being positioned a short distance down.

This hand structure is generally referred to as the metacarpal and the phalanges. The phalanges are the finger bones while the mertacarpus comprises the metacarpal bones. These latter extend between wrist and fingers defining the palm area. The upper bulge 14 is at the junction of the metacarpal bones and phalanges. The lower bulge 15 overlies the outer, or upper, part of the metacarpus.

Individual bulges 16 for each finger are positioned on each finger portion of the glove, at the first finger joint or knuckle from the junction of metacarpus and phalanges. There is a further bulge 17 on the thumb portion and this is positioned approximately at the junction between the thumb portion and the main portion of the glove.

The transverse extent of the bulges is such that the ends are at positions of substantially no distortion. Thus, considering bulges 14 and 15, they extend completely across the back, the ends flush with the sides of the hand. There is a short transition portion extending from each end of a bulge to the maximum height and width. Similarly, the bulges 16 and 17 extend across the back of each finger, and thumb, the ends flush with the sides of the related finger or thumb, again with a short transition portion at each end. The transition portions enable smooth, rounded ends for each bulge. This eases manufacture.

In action, as the hand is bent, first bulge 14 disappears. As the fingers are bent so the bulges 16 disappear. The same occurs for the thumb. In using ones hands for gripping and manipulation, the majority of bending occurs at the junction between the metacarpus and phalanges, for the fingers, the next major bending occurring at the first joint in the fingers. Bending also occurs at the top two points of the thumb. The bulge 17 provides flexibility for the thumb. It is at these positions that bulges 14, 16 are placed for the fingers, giving extreme flexibility. The additional bulge 15 allows for some stretching at the back of the hand. Under some circumstances it may be that this bulge, 15, could be omitted, with reduced flexibility.

The glove illustrated is for the left hand and, of course, a similar glove is made for the right hand, but reversed. The size of the bulges, the distance between the bulges 14 and 15, and positioning of the bulges will depend upon glove size. As an example, considering FIG. 2, for a glove of "Large" size the distance "a" between bulges 14 and 15 is about ½". Also the height of a bulge is about ½". The bulges have a general sinusoidal cross-section, although this can vary. The total thickness is illustrated in FIG. 2 by the dotted line 18, while the smooth inner profile is indicated by chain-dotted line 19. The distance between the line 10 and the line 19 is the height and as stated is about ½ inch, particularly for the bulge 14. Bulges 15 and 16 may be slightly lower. Bulge 17 is also of the same order as bulge 14. These heights will reduce slightly for Medium and Small gloves and possibly increase slightly for Extra Large gloves. However these dimensions are an indication only. The intent is to provide spare material at the major bending positions to give flexibility. Sufficient material is provided that closing of the fist can be obtained, but preferably no excess material such that some residual bulge remains after closing or gripping, to avoid having protrusions which might catch in, or on, parts of a structure being serviced.

The gloves are made by dipping forms into latex liquid, the gloves being formed by a number of dips, the number depending upon the rubber thickness required. Up to 26 or more dips are required for 20,000 Volt protection. After forming of the rubber inner layer, the urethane layer is formed. The urethane can be applied by spraying or by dipping the rubber glove into a urethane liquid.

The urethane layer can be entirely of urethane or a urethane composite can be used, for example urethane with a filler such as talc or mica. The term urethane is intended to cover such variations.

The major advantage of the present invention is that the bulges, providing spare material, are completely seamless, as is the entire glove. Thus no joins or seams are required to form the bulges. Such joins or seams would be dangerous, creating weak points and possible leakage paths for moisture which would be very dangerous at the high voltages vt which these gloves are intended to protect. The bond between rubber and urethane is very good. The flexibility of the glove, and ability to crease or buckle at the inside of the hand, is not restricted by an outer, relatively stiff, covering.

Normally, because use of the gloves causes sweating of the hands, because of no ventilation, a pair of cotton gloves are first put on. After the protective gloves have been used for a while, they can be removed, the damp cotton gloves removed and dry ones put on, the protective gloves then put back on.

Because of their flexibility and ease and comfort in use, there is less likelihood of a user removing a glove to carry out a difficult manipulation. The length of the sleeve portion of a glove is as desired.

What is claimed is:

1. A seamless, flexible, tear resistant protective glove comprising:

an inner layer of natural rubber of a thickness of at least about 0.040 inches;

an outer layer of a urethane elastomer bonded to said inner layer and of a thickness of at least about 0.003 inches;

a plurality of bulges extending laterally across the back of the glove, said bulges defined by seamless extensions of said layers from the normal contour of the glove and molded integrally therewith, the glove having a back portion, fingers and thumb;

said bulges comprising; a first bulge extending transversely across the back portion of the glove at a position substantially aligned with the junction of metacarpal bones and phalanges of a user;

a second bulge extending transversely across the back portion of the glove, spaced from and substantially parallel to said first bulge at a position substantially overlying the upper part of the metacarpus of the user;

an individual bulge across the back of each finger and positioned at the first joint from the metacarpus;

a bulge extending across the back of the thumb and positioned at the second joint from the thumb tip;

said bulges extending to be flush with the sides of the back portion of the glove and the sides of the fingers and thumb respectively, and including a transition portion at each end of each bulge.

2. A glove as claimed in claim 1, said urethane elastomer including a filler.

3. A glove as claimed in claim 1, said filler are of mica or talc.

4. A glove as claimed in claim 1, said inner layer having a thickness from about 0.040″ to about 0.120″, said urethane layer having a thickness of about 0.003″ to 0.010″.

5. A glove as claimed in claim 1, the height of a bulge being about ½″.

6. A glove as claimed in claim 1, said bulges having a height substantially equal to the spacing between bulges.

* * * * *